United States Patent [19]

Shafer et al.

[11] 3,965,514

[45] June 29, 1976

[54] ADJUSTABLE AND/OR REMOVABLE FIN FOR SURFBOARDS

[76] Inventors: Arthur B. Shafer, 109 Coalinga Way, Santa Cruz; James E. Richardson, 1425 Trout Gulch Road, Aptos, both of Calif. 95003; Jay L. Shuirman, 101 24th Ave., Santa Cruz, Calif. 95060

[22] Filed: Jan. 30, 1975

[21] Appl. No.: 545,762

[52] U.S. Cl. ..... 9/310 E

[51] Int. Cl.[2] ..... A63C 15/00

[58] Field of Search ..... 9/310 R, 310 A, 310 B, 9/310 C, 310 E, 310 F; 114/140

[56] References Cited

UNITED STATES PATENTS

| | | | |
|---|---|---|---|
| 2,119,881 | 6/1938 | Kline | 114/140 |
| 3,096,530 | 7/1963 | Almgren | 9/310 A |
| 3,395,411 | 8/1968 | Pope, Jr. et al. | 9/310 A |
| 3,516,099 | 6/1970 | Morey et al. | 9/310 E |
| 3,564,632 | 2/1971 | Bahne, Jr. | 9/310 E |
| 3,579,681 | 5/1971 | Pope et al. | 9/310 E |
| 3,659,300 | 5/1972 | Johnson | 9/310 E |

*Primary Examiner*—Trygve M. Blix
*Assistant Examiner*—Jesus D. Sotelo
*Attorney, Agent, or Firm*—Paul B. Fihe

[57] ABSTRACT

A removable fin unit for a surfboard including a fin having integral fillets on opposite sides thereof together with thread members for removably joining such fillets to the surfboard.

5 Claims, 4 Drawing Figures

Fig-1
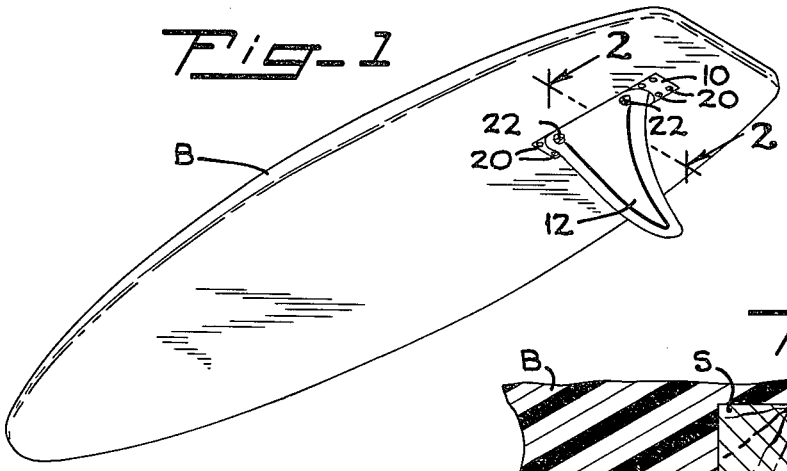
Fig-2
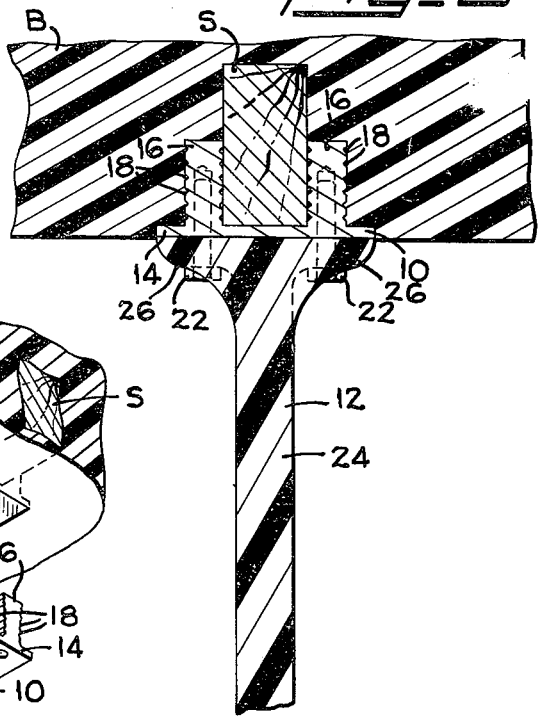
Fig-3
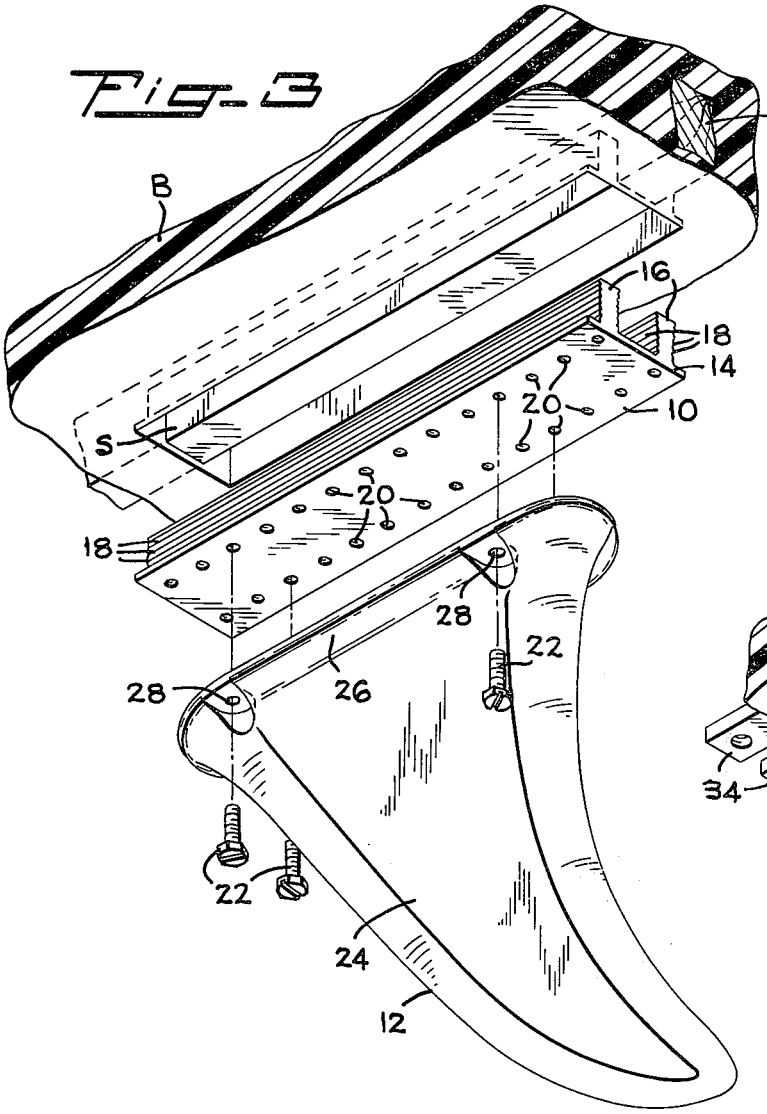
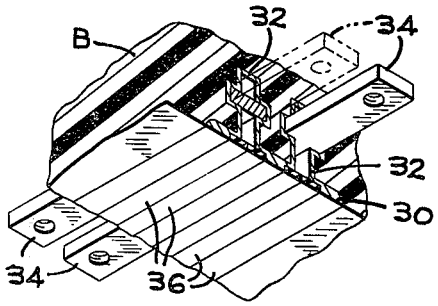
Fig-4

ADJUSTABLE AND/OR REMOVABLE FIN FOR SURFBOARDS

FIELD OF THE INVENTION

The present invention generally relates to surfboards and more particularly to a removable fin unit for a surfboard.

BACKGROUND OF THE INVENTION

As surfing has increased in popularity to the point that international competition is now prevalent, various refinements and structural and design changes in surfboards have been made in an effort to provide optimum effectiveness in the surfing operation. As obvious examples, the overall length of surfboards has decreased in recent years, and it is now common to mold surfboards from polyurethane foam with longitudinally extending bars or stringers for reinforcement. Experienced surfers have also found that the precise shape and/or disposition of the control fin on the undersurface of the surfboard are critical and attempts have been made to provide a removable and/or adjustable fin arrangement enabling accommodation of the many variables encountered such as the size and weight of the particular surfer, the types of waves encountered, and the size and weight of the surfboard itself. While such adjustable or removable fin system is theoretically advantageous, certain practical difficulties have been encountered with the proposed arrangements. In the first place, it being recognized that the fin provides lateral stability in the control of the surfboard, it is essential that no fin base wobble in relation to the surfboard be introduced and such, regretably, has not been achieved. Furthermore, the most common adjustable units now in use employ a box support for the fin which is inserted into the body of the surfboard in the desired position and accordingly requires a cutting away of the central reinforcing bar or stringer so as to weaken the strength of the surfboard itself, an obviously undesirable effect. Finally, all of the proposed and now utilized removable or adjustable fin units in addition to the mentioned wobble, also introduce additional hydrodynamic inefficiency in the form of their structural characteristics which produce excessive separation drag and gross turbulence. As one example, the mentioned box structure provides an elongated opening in the bottom of the board which produces a gross amount of such separation drag and turbulence, thus reducing the fin efficiency in its control function.

SUMMARY OF THE PRESENT INVENTION

Accordingly, it is the general objective of the present invention to provide a removable and/or adjustable fin unit for a surfboard arranged to provide the optimum hydrodynamic efficiency in the control function of the fin and moreover, which fin unit can be installed without adverse structural or other deleterious effects to the surfboard itself. Briefly, such objective is achieved by providing a fin having an overall size and shape which may vary widely dependent upon the environmental surfing conditions and the choice of the particular surfer but which, in accordance with the present invention includes integral lateral fillets on opposite sides of its base whereat it abuts the surfboard. These fillets are formed to enable the removable and/or longitudinally adjustable juncture of the fin to the surfboard by means which provide rigidity (in the engineering sense) of the fin base in its connection to the surfboard. Preferably, the fillets have two or more holes formed therein to enable bolted or other removable connection directly to the surfboard or alternatively, because of the composition of standard surfboards, to a fin holder which is itself formed to enable the removable connection of the fin thereto without weakening the surfboard itself and in a fashion avoiding any wobble of the fin base.

By way of example, one embodiment takes the form of a removable and/or adjustable fin unit consisting of but two major elements, an elongated fin holder which is adapted for ready connection to a surfboard and a fin arranged for removable and/or adjustable connection at selected positions along the length of the fin holder itself. More particularly, the fin holder is preferably formed of an open-ended, rectangular trough whose sides are spaced a sufficient distance apart so that the central longitudinal stringer or reinforcing bar of the plastic surfboard can be encompassed therebetween. Thus, to mount the fin holder on an existent surfboard of this type, it is merely necessary to open up small channels in the plastic material on either side of the stringer for reception of the sides of the trough, the depth of the channels being such that the bottom of the trough is substantially coplanar with the bottom of the surfboard when the installation is completed by application of a suitable adhesive. Preferably, to render the connection of the fin holder to the surfboard more secure, longitudinal grooves along the sides of the fin holder are formed to enhance the holding forces. As will be obvious, since the reinforcing bar or stringer of the conventional surfboard remains completely intact, no adverse effects on the structural strength of the surfboard are encountered.

Since the trough is open-ended and of uniform cross section, it is apparent that it can be formed by a simple extrusion process which not only reduces the cost of manufacture, but allows the fin holder unit to be formed with any desirable length depending upon the surfboard to which it is to be applied. Furthermore, it may be mentioned that if the fin holder is to be applied to a surfboard having a shallow V-shaped configuration at its bottom surface, a mere change in the shape of the extrusion die will enable the bottom of the trough of the fin holder to be formed to correspond to the bottom of the surfboard thus to maintain a coplanar continuity between these surfaces.

The fin itself may have any conventional major contour and shape, but is formed with lateral fillets at opposite sides of its base, which base is in turn formed to abut the exposed bottom of the fin holder trough, thus to provide a continuity between these surfaces. The curved conformation of the base fillets, in accordance with known hydrodynamic theory, introduces a minimal amount of interference drag, and at the same time, allows a particularly effective yet simple mechanism for providing connection of the fin in longitudinally adjusted position on the adjacent fin holder. Preferably, such connecting means takes the form of two or more holes through the fillets on each side of the fin base for the reception of bolts at positions spaced appropriately to register with a plurality of tapped, threaded openings that extend downwardly through the sides of the fin holder so that substantial depth of such threaded holes is achieved to enable, by the application of the described machine screws or bolts at positions on opposite sides of the fin a rigid, non-wobbling connection of the fin in its adjusted position to the fin holder. When so connected in adjusted position, the fillets provide, as mentioned hereinabove, a smooth curved juncture with the bottom of the surfboard so that the fin, regardless of its particular adjusted disposition, functions excellently and reduces vortex roll-off drag, interference drag, and other hydrodynamic problems.

While the fin is rigidly mounted to the fin holder so that no wobbling results between the fin and fin holder, it can be formed of a high-impact but slightly resilient material such as a polycarbonate plastic so that a slight flexing of the fin at its outer extremity provides additional reactive force effects which further enhance its control efficiency.

While many variations can be envisioned, one particular modified fin holder unit should be mentioned since it allows a continuous rather than stepped adjustment of the fin to be made. The fin holder remains in the general form of an inverted trough but each side of the trough has a continuous longitudinal channel with an enlarged section which can slidably accommodate a nut to which the fin-attaching bolts can be secured in any adjusted disposition.

BRIEF DESCRIPTION OF THE DRAWING

The stated objective of the invention and the manner in which it is achieved as summarized hereinabove will be more fully understood by reference to the following detailed description of the exemplary embodiments of the invention shown in the accompanying drawing wherein:

FIG. 1 is a perspective view of the undersurface of a surfboard having a removable fin unit embodying the present invention attached thereto, FIG. 2 is a greatly enlarged cross-sectional view taken along line 2—2 of FIG. 1 illustrating structural details of the removable fin unit and its manner of attachment to the surfboard, FIG. 3 is an exploded perspective view of the elements of the removable fin unit of FIGS. 1 and 2, and FIG. 4 is a fragmentary perspective of a modified embodiment, with portions of the structure broken away to illustrate details.

DETAILED DESCRIPTION OF THE EXEMPLARY EMBODIMENT OF THE INVENTION

The surfboard B as shown in FIG. 1 is of a standard type formed by the molding of polyurethane foam including a central longitudinally-extending bar or stringer S, as indicated in FIG. 2. Such stringer S can be formed from wood, plastic, metal or any other suitable material forming in and of itself no part of the present invention.

The fin holder 10 for longitudinal adjustable mounting of a fin 12 in accordance with the present invention is in the form of an elongated, rectangular trough including a bottom portion 14 and two upstanding side portions 16 which are spaced a distance sufficient to enable accommodation therebetween of the central stringer S of the surfboard B. Accordingly, the fin holder 10 can be mounted on an existing surfboard B by the mere routing or other cutting operation of the expanded plastic foam for a predetermined distance along the sides of the stringer S and to a depth such that the sides of the fin holder 10 can be inserted therein to bring the exposed surface of the bottom 14 of the trough into substantially flush co-planar relationship with the bottom of the board itself, as can be best visualized by reference to FIG. 2. Once so inserted, suitable adhesive sealant material can be used to join the fin holder 10 in its assembled position with the surfboard. Preferably to aid in the effective attachment of the fin holder 10 to the surfboard B, longitudinal grooves 18 are formed in the outer or inner surfaces of the sides 16 so that the mentioned sealant adhesive material provides an effective, rigid connection. The fin holder 10 can be formed from strong impact-resistant plastic material such as a polycarbonate, metal, or any other material having the desired, requisite strength characteristics. In any case, the fin holder can be formed by an extrusion process since the cross-section of the fin holder 10 is regular and this, in turn, allows the fin holder to be formed with any desired overall length.

At spaced intervals along the length of the fin holder 10, a plurality of holes 20 are drilled and tapped from the bottom surface 14 of the trough into the upstanding sides 16 thereof so that each threaded hole will have a substantial depth, but on the other hand, will have a relatively narrow transverse dimension which, in accordance with known hydrodynamic theory, will present substantially no interference with the flow of water thereacross. It will be particularly observed that the trough configuration of the fin holder 10 enables its attachment to the surfboard B without any cutting or notching of the stringer S so that its strength is not reduced. Additionally, a minimal amount of material can be used for construction of the fin holder 10 but, at the same time, will provide through the dimensions of the sides of the trough, the mentioned considerable depth for attachment of threaded bolts 22 to be described hereinafter.

The fin 12 itself can be formed of any particular material, but again is preferably formed by a polycarbonate or other high impact resistant and resilient plastic by a suitable molding process. More particularly, the shape of the main body portion 24 of the fin 12 can be that desired but the molding process also permits the integral formation with the main body portion of the fin of laterally curving fillets 26 whose bottom surface is substantially flat so as to abut the undersurface of the fin holder 10, again as can best be visualized by reference to FIG. 2. Thus, the fillets 26 provide a smooth, curved juncture with the undersurface of the surfboard B so as to provide hydrodynamic efficiency and more particularly a minimal amount of interference drag and other hydraulic problems at the points of juncture. Holes 28 are drilled through the fillets 26 on opposite sides of the fin 24 in positions so as to be capable of registration with different holes 20 in the adjacent fin holder 10. Preferably as shown, two holes 28 are drilled in the fillet on each side of the fin for the reception of securing members such as the mentioned bolts or machine screws 22 which can pass therethrough to enter the threaded holes 20 in the fin holder 10 to enable connection. Such connection is made more rigid by the lateral spacing of the holes 28 on opposite sides of the fin 12 so as to oppose any transverse forces experienced by the fin during a turning operation.

Quite obviously, if the longitudinal position of the fin 12 is to be shifted, it is merely necessary to remove the bolts or machine screws 22 and then shift the fin 12 longitudinally until alignment with another selected set of threaded holes 20 in the fin holder 10 is achieved whereupon the bolts 22 can be reapplied. A rigid connection is made and no wobbling of the fin base in its adjusted position is encountered, but, on the other hand, some flexing of the slightly resilient extremity of the fin 12 is allowed.

The arrangement not only allows the longitudinal adjustment of the position of a particular fin, but ready substitution of a fin having one particular configuration with a different configuration but an identical fillet and hole disposition. Furthermore, when the surfboard is to be shipped or stored, the fin can be removed to avoid accidental damage.

The fin holder 10 also is readily adapted for mounting on the type of surfboard having a hard outer shell and of course can be dimensionally modified as required for each type of installation. Furthermore many constructional deviations can be envisioned within the scope of the invention.

One modified fin holder 30 allowing continuous longitudinal adjustment rather than adjustment in discrete steps as in the first embodiment is shown in FIG. 4. Generally, the fin holder 30 is also in the form of an inverted trough which is attached to the hard outer shell in the bottom of a surfboard B. Both sides of the trough have longitudinal channels 32 which are centrally widened to slidably accommodate rectangular straps 34 with threaded holes spaced to receive at any selected position the bolts 22 which attach the fin 12. Flexible plastic or rubber strips 36 cover the longitudinal channels 32 but permit the entry of the bolts 22.

A number of additional variations in the details of the structure as specifically described hereinabove can be made within the general spirit of the present invention, and the foregoing description of two exemplary embodiments is accordingly to be considered as purely exemplary and not in a limiting sense, and the scope of the present invention is to be indicated only by reference to the appended claims.

What is claimed is:

1. A removable fin unit for a surfboard which comprises a fin having integral fillets at opposite sides of its base and arranged to abut the bottom of the surfboard, and means for removably joining said fillets to said surfboard, said joining means including a fin holder having the conformation of an open-ended rectangular trough, the sides of which are adapted for insertion into the bottom of surfboard and connection thereto in a position such that the bottom of the trough is substantially flush with the bottom of the surfboard.

2. A removable fin unit according to claim 1 wherein the sides of said fin holder are spaced a distance to accommodate the central stringer of a surfboard therebetween.

3. A removable fin unit according to claim 1 wherein the sides of said fin holder include longitudinal grooves.

4. A removable fin unit according to claim 1 wherein said joining means includes a plurality of threaded holes extending into the sides of said trough from its bottom surface, and holes through said fin fillets arranged for registry with selected threaded holes in said trough sides and bolts passing through said fin holes into the selected threaded holes in said trough sides.

5. A removable fin unit according to claim 1 wherein the sides of said rectangular trough each include longitudinal channels which are centrally widened to slidably support straps having holes therein which are adapted to receive bolts passing through said fin holes.

* * * * *